United States Patent [19]

Fajardo

[11] 4,058,046

[45] Nov. 15, 1977

[54] CYLINDRICAL HEAD JOINT WITH ACOUSTIC WEDGING FOR CONCERT FLUTES

[76] Inventor: Raoul J. Fajardo, P.O. Box 5782, Pasadena, Calif. 91107

[21] Appl. No.: 711,157

[22] Filed: Aug. 3, 1976

[51] Int. Cl.[2] ..... G10D 7/02

[52] U.S. Cl. ..... 84/384; 84/386

[58] Field of Search ..... 84/380, 384, 386, 380 C

[56] References Cited

U.S. PATENT DOCUMENTS

| | | | |
|---|---|---|---|
| 1,376,004 | 4/1921 | Christensen | 84/384 |
| 3,763,737 | 10/1973 | Sander | 84/384 |

FOREIGN PATENT DOCUMENTS

| | | | |
|---|---|---|---|
| 114,964 | 4/1942 | United Kingdom | 84/384 |

*Primary Examiner*—Lawrence R. Franklin
*Attorney, Agent, or Firm*—Fraser and Bogucki

[57] ABSTRACT

A cylindrical head joint has an internal cross-section that tapers down from a cylindrical shape at the tenon to a non-cylindrical shape at the embouchure end by means of a wedge internally bonded to the cylinder. The relative tuning of the three octaves of the flute can be achieved by varying the position of the wedge either rotationally or longitudinally inside the cylinder. The laborious method of tapering the head by forced shrinking of a cylindrical tube is thus avoided and a superior tone quality is achieved because the air jet that enters the embouchure hole hits a non-cylindrical wall which has a favorable effect on transient sounds and harmonics.

14 Claims, 9 Drawing Figures

Fig. 1
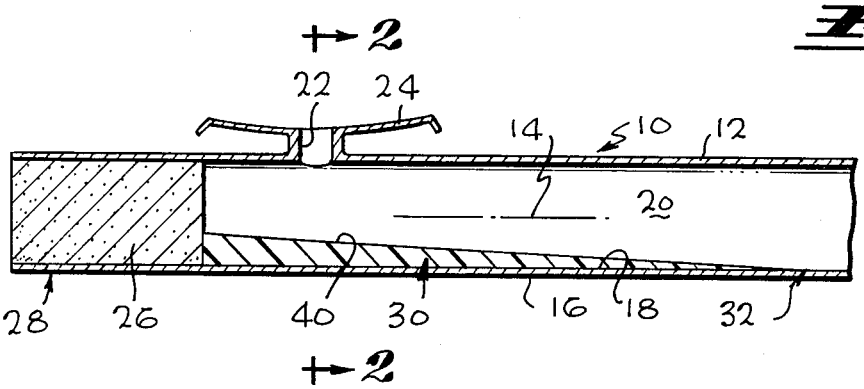
Fig. 2
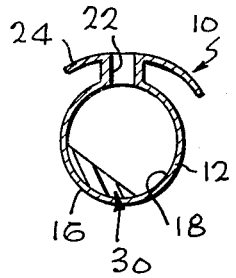
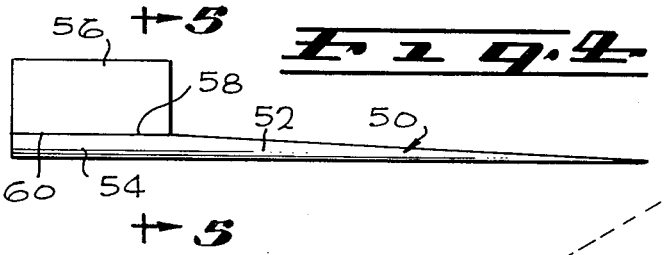
Fig. 4
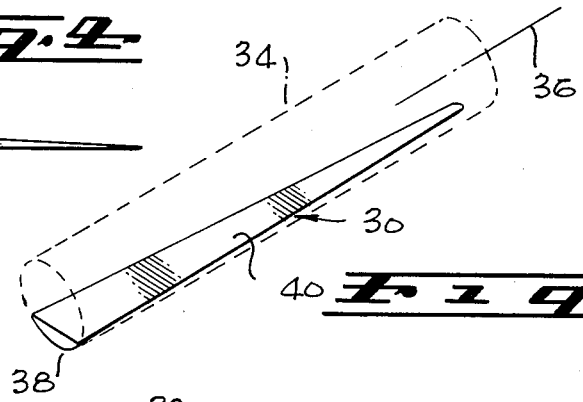
Fig. 3
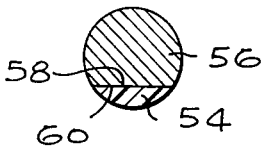
Fig. 5
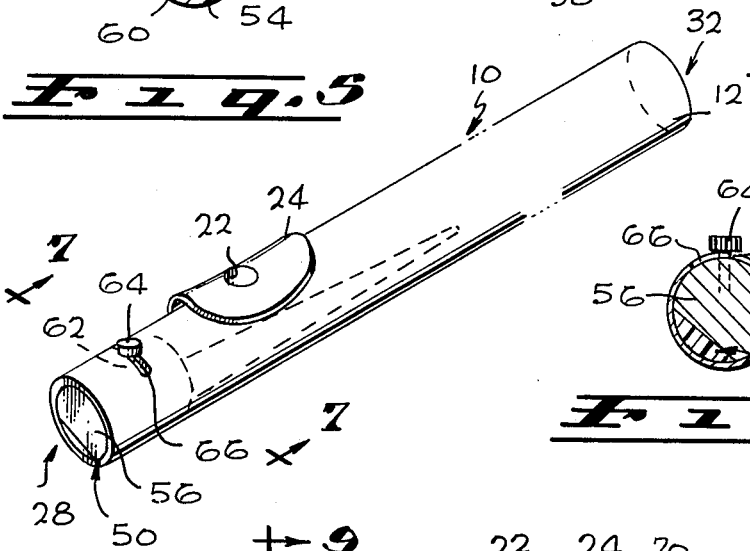
Fig. 6
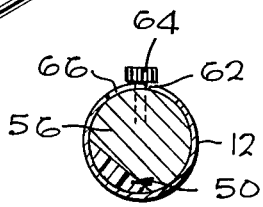
Fig. 9
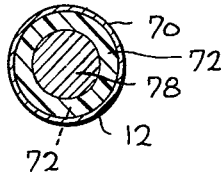
Fig. 7
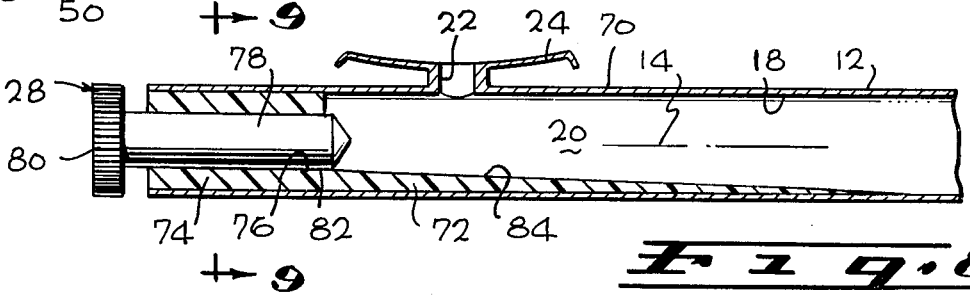
Fig. 8

CYLINDRICAL HEAD JOINT WITH ACOUSTIC WEDGING FOR CONCERT FLUTES

BACKGROUND OF THE INVENTION

1. Field of the Invention

This invention relates to a head joint for a concert flute and more particularly to a head joint having an acoustic taper defined by a wedge disposed within a cylindrical chamber.

2. Description of the Prior Art

One popular wind type of musical instrument has come to be known as the Boehm or concert flute. The Boehm flute traditionally includes a head joint which is detachably connected to a body portion having fingering holes and keys thereon. The head joint has a circular cross-section which is smoothly tapered from a relatively large diameter at the connecting or tenon end to a smaller diameter at the opposite end which is normally closed by a cork. While the internal diameter traditionally has a parabolic taper, modern manufacturing techniqus have often produced a metallic head joint having a linear taper. An embouchure hole is located near the closure end and an embouchure plate is conventionally affixed to the head joint at the embouchure hole to provide a desired increased depth therefor.

A conventionally constructed Boehm flute has several undesirable limitations. Because of manufacturing difficulties, an approximately parabolic taper is seldom available in commercial flutes. The manufacture of wooden or non-metallic head joints is particularly uneconomical because of the requirement for expensive boring tools which must be frequently reconditioned. A head joint with the required inner taper cannot be economically produced from materials such as plastics, which are commercially available in easily manufactured cylindrical shapes and cannot be forced from a cylindrical shape into a tapered form except through very impractical or expensive manufacturing methods.

SUMMARY OF THE INVENTION

A flute head joint in accordance with the invention includes a cylindrical wall with an embouchure hole therethrough defining an inner cylindrical chamber, a closure element disposed to close one end of the cylindrical chamber and a wedge positioned within the cylindrical chamber in abutment with the closure element. The wedge has one end with a largest cross-sectional area in butment with the closure element and extends from the closure end past the embouchure hole to an opposite end of smaller cross-sectional area. The wedge is preferably defined by a cylinder conforming to the hollow cylinder of the head joint truncated by a plane at an acute angle relative to a central axis of the hollow cylindrical chamber. A pin secured to the wedge may extend through the cylindrical wall to permit rotational positioning of the wedge about the central axis of the hollow cylinder and the closure element may extend beyond the end of the hollow cylinder to terminate in an enlarged handle end permit axial positioning of the closure element. The wedge and closure element may be manufactured either separately or integrally as a single unitary piece of material and may be selectively rotationally and axially positioned to provide excellent tuning over the three octaves of the flute. Since the cylindrical chamber may be defined by a non-tapered cylindrical tube, any commercially available tubing whether metallic or non-metallic can be conveniently used to define the head joint. Similarly, the wedge defining the inner taper of a cylindrical chamber may be of suitable metallic or non-metallic material.

BRIEF DESCRIPTION OF THE DRAWINGS

A better understanding of the invention may be had from a consideration of the following detailed description taken in conjunction with the accompanying drawings in which:

FIG. 1 is a sectional side view of a flute head joint in accordance with the invention taken along a plane passing through a longitudinal central axis of the head joint;

FIG. 2 is a sectional end view of the head joint shown in FIG. 1 taken along plane 2—2;

FIG. 3 is a perspective view of a wedge used in the head joint shown in FIG. 1;

FIG. 4 is an alternative embodiment of a wedge and closure element assembly for use in the head joint shown in FIG. 1;

FIG. 5 is a sectional end view of the assembly taken along plane 5—5 as shown in FIG. 4;

FIG. 6 is a side view of an alternative embodiment of a flute head joint in accordance with the invention;

FIG. 7 is a sectional end view of the head joint taken along plane 7—7 shown in FIG. 6;

FIG. 8 is a sectional side view of a flute head joint in accordance with the invention taken along a plane passing through a central axis of the head joint; and FIG. 9 is a sectional end view of the head joint taken along plane 9—9 as shown in FIG. 8.

DETAILED DESCRIPTION

As shown in FIG. 1, to which reference is now made, a head joint 10 in accordance with the invention for a concert or Boehm flute includes a thin cylindrical wall 12 extending along a central axis 14 and having a cylindrical outer surface 16 and a cylindrical inner surface 18 defining a cylindrical hollow acoustic chamber 20. An embouchure hole 22 extends through the wall 12 providing communication between the outer surface 16 and chamber 20 and an embouchure plate 24 surrounds the embouchure hole to receive the lips of a flute player and increase the thickness of the hole 22. A cylindrical closure element 26 such as cork is positioned to close the hollow cylindrical chamber 20 between the embouchure hole 22 and a closure end 28 of the head joint 10 and a wedge 30 extends from abutment with the closure element 26 axially past the embouchure hole 22 toward a tenon end 32 of the head joint 10.

As further illustrated in FIGS. 2 and 3, while the wedge 30 may have other shapes it is advantageously defined by a plane truncating a cylinder 34 having a central axis 36 at an acute angle with respect to the axis 36. The wedge thus has a cylindrical surface 38 which engages the inner surface 18 of wall 12 in conformal mating relationship and a flat surface 40. The wedge 30 may be positioned generally opposite the embouchure hole 22 and selectively rotated about axis 14 to permit tuning of the head joint 10 by selectively changing the angle of the wall opposite the embouchure hole 22 or its longitudinal distance from the embouchure hole 22.

While the shape and dimensions of the wedge may be manufactured as desired, in one preferred embodiment a wedge in the shape of the wedge 30 shown in FIG. 3 has a cylindrical surface 38 with a diameter of approximately ¾ inch, a maximum thickness of approximately 3/16 inch, an axial length of approximately 4 11/16 inches, and a taper along a flat surface 40 at an angle of approximately 2.3° with respect to axis 36 to a zero cross-sectional area at a small end opposite the large end.

In an alternative arrangement shown in FIGS. 4 and 5 a wedge 50 has a wedged shaped section 52 identical to the wedge 30 shown in FIGS. 1–3 and a constant cross-section part 54 which extends axially from the wedge shaped portion 52 to the closure end of the head joint 10 with a cross-section that conforms to and abuts with the cross-section of the large end of the wedge portion 52. A cylindrical element 56 has a flat created on one side thereof to engage a flat portion 60 of the non-tapered or constant cross-section portion 54 of wedge 50. The closure element 56 thus closes the portion of the hollow cylindrical chamber 20 that is not closed by the constant cross-section portion 54 of wedge 50. The closure element 56 may be selectively axially positioned within the cylindrical chamber 20 to provide proper tuning of the head joint 10. This axial positioning may be independent of the axial position of the wedge 50.

As further shown in FIGS. 6 and 7, the closure element 56 shown in FIGS. 4 and 5 may be provided with a pin 62 such as a set screw 64 which extends through a pin hole or slot 66 in the wall 12 to provide for selective rotational positioning of the closure element 56 and hence the wedge 50. The hole 66 is conveniently positioned between the embouchure plate 24 and closure end 28 of the head joint 10 at a circumferential position just behind the embouchure hole 22. After the closure 56 and wedge 50 are rotationally positioned as desired, the set screw 64 may be tightened to inhibit further changes in the positions of these elements relative to the wall 12.

In still another embodiment shown in FIGS. 8 and 9, a head joint 70 is manufactured with a wedge 72 being integral with a cylinder 74 having an outer circumference which sealing engages the inner circumference 18 of wall 12 at the closure end 28 and has a central bore 76 extending axially therethrough concentric with the central axis 14 of the head joint 70. A generally cylindrical closure element 78 of about 7/16 inch diameter extends through the central bore 76 and extends beyond the closure end 28 to terminate in an enlarged end forming a handle 80 to provide convenient axial positioning of the closure element 78. The diameter of the bore 76 is advantageously selected to cause the bore 76 to be tangential with a termination point 82 of a taper plane 84 of wedge 72.

While there have been shown and described various arrangements of a flute head joint in accordance with the invention for the purpose of enabling a person of ordinary skill in the art to make and use the invention, it will be appreciated that the invention is not limited thereto. Accordingly, any modifications, variations, or equivalent arrangements within the scope of the attached claims should be considered to be within the scope of the invention.

What is claimed is:

1. A flute head joint comprising:

a wall having an embouchure hole therethrough and a closed inner surface defining a hollow cylinder extending along a central axis between opposite ends of the wall;

a closure element disposed to close the hollow cylinder between one end and the embouchure hole; and a wedge positioned within the hollow cylinder and decreasing continually in cross-sectional area from one end disposed on one side of the embouchure hole to an opposite end disposed on an opposite side of the embouchure hole a substantial distance therefrom to provide an acoustic taper to the hollow cylinder.

2. The flute head joint according to claim 1 above, wherein the wedge has a part cylindrical outer surface disposed in mating conformal relationship with the inner surface of the wall throughout at least an axially extending portion of the wedge which decreases continuously in crosssectional area.

3. The flute head joint according to claim 1 above, wherein the one end of the wedge is in abutment with the closure element.

4. The flute head joint according to claim 1 above, further comprising a pin that is secured to the wedge and extends through the wall to provide selective tuning of the head joint by enabling selective rotational positioning of the wedge about the central axis of the hollow cylinder.

5. The flute head joint according to claim 1 above, further comprising a constant cross-section element having a cross-section of the same shape and size as a cross-section of the one end of the wedge and positioned to extend from the one end of the wedge to the one end of the hollow cylinder and wherein the closure element has a cross-sectional shape conforming to a cross-section of the hollow cylinder at the one end that is not occupied by the constant cross-section element.

6. The flute head joint according to claim 5 above, wherein the wall has a pin hole therethrough for receiving a pin and further comprising a pin secured to the wedge and extending through the pin hole to permit rotational positioning of the wedge about the central axis of the hollow cylinder and means for selectively inhibiting motion of the pin.

7. The flute head joint according to claim 1 above, wherein the closure element includes a first portion having a central aperture extending axially therethrough and a second portion that is axially movable within the central aperture of the first portion.

8. A flute head joint defined by a cylindrical wall that is closed at one end and has an embouchure hole therethrough and a wedge secured within a chamber defined by the cylindrical wall and imparting an acoustic taper to the chamber, the wedge extending with continuously decreasing cross-sectional area from a closed end of the chamber past the embouchure hole, at least a portion of the wedge extending past the embouchure hole engaging the cylindrical wall in conformal mating relationship.

9. A flute head joint comprising:

a wall having an embouchure hole therethrough and a closed inner surface defining a hollow cylinder extending along a central axis between opposite ends of the wall;

a closure element disposed to close the hollow cylinder between one end and the embouchure hole; and a wedge positioned within the hollow cylinder with one end of the wedge having a given cross-sectional area positioned nearer the closure element and decreasing continuously in crosssectional area to an opposite end on the other side of the embouchure hole, the closure element and wedge being a single unitary, integral piece of material.

10. A flute head joint comprising:

a wall having an embouchure hole therethrough and a closed inner surface defining a hollow cylinder extending along a central axis between opposite ends of the wall;

a closure element disposed to close the hollow cylinder between one end of the hollow cylinder and the embouchure hole; and a wedge positioned within the hollow cylinder with one end having a given cross-sectional area positioned nearer the closure element than an opposite end having a smaller cross-sectional area than the area of the one end of the wedge, the wedge having the shape of a cylinder with a central axis and a diameter equal to a diameter of the hollow cylinder defined by the wall, truncated by a plane having an acute angle with respect to the central axis of the wedge.

11. The flute head joint according to claim 10 above, wherein the acute angle is approximately 2.3°.

12. The flute head joint according to claim 10 above, wherein the wedge is positioned with a cylindrical outer circumference in mating abutment with the inner surface of the wall and further comprising means for changing the rotational position of the wedge about the central axis of the hollow cylinder.

13. The flute head joint according to claim 10 above, wherein the wedge is coupled to the closure element and further comprising means for controlling the axial position of the wedge and closure element.

14. The flute head joint according to claim 10 above, further comprising an embouchure plate disposed about the embouchure hole.

* * * * *

UNITED STATES PATENT AND TRADEMARK OFFICE

CERTIFICATE OF CORRECTION

PATENT NO. : 4,058,046

DATED : November 15, 1977

INVENTOR(S) : Raoul J. Fajardo

It is certified that error appears in the above-identified patent and that said Letters Patent are hereby corrected as shown below:

Column 1, line 22, "technigus" should read --techniques--; line 49, after "in" and before "with", "butment" should read --abutment--; line 60, after "handle", "end" should read --and--. Column 4, line 11, after "in", "crosssectional" should read --cross-sectional--; line 62, before "and", insert --than an opposite end having a smaller cross-sectional area than the area of the one end of the wedge--; line 63, "crosssectional" should read --cross-sectional--.

Signed and Sealed this

Ninth Day of May 1978

[SEAL]

Attest:

RUTH C. MASON
Attesting Officer

LUTRELLE F. PARKER
Acting Commissioner of Patents and Trademarks